US008310156B2

(12) United States Patent
Grundmann

(10) Patent No.: US 8,310,156 B2
(45) Date of Patent: Nov. 13, 2012

(54) HIGH-PRESSURE DISCHARGE LAMP AND VEHICLE HEADLIGHT WITH HIGH-PRESSURE DISCHARGE LAMP

(75) Inventor: Dirk Grundmann, Berlin (DE)

(73) Assignee: Osram AG, Munich (DE)

( * ) Notice: Subject to any disclaimer, the term of this patent is extended or adjusted under 35 U.S.C. 154(b) by 0 days.

(21) Appl. No.: 12/532,163

(22) PCT Filed: Apr. 11, 2008

(86) PCT No.: PCT/EP2008/054447

§ 371 (c)(1),
(2), (4) Date: Jan. 22, 2010

(87) PCT Pub. No.: WO2008/128910

PCT Pub. Date: Oct. 30, 2008

(65) Prior Publication Data

US 2010/0141137 A1 Jun. 10, 2010

(30) Foreign Application Priority Data

Apr. 19, 2007 (DE) ..... 10 2007 018 614

(51) Int. Cl.
*H01J 61/12* (2006.01)

(52) U.S. Cl. ..... 313/570; 313/637

(58) Field of Classification Search ..... 313/623–625, 313/493, 318.12, 570, 578, 631–637, 640, 313/642

See application file for complete search history.

(56) References Cited

U.S. PATENT DOCUMENTS

| | | | | |
|---|---|---|---|---|
| 4,992,700 | A | 2/1991 | Lake | |
| 5,013,968 | A | 5/1991 | Russel et al. | |
| 5,726,532 | A | 3/1998 | Wittig et al. | |
| 6,809,478 | B2 | 10/2004 | Yoshida et al. | |
| 7,126,281 | B2 | 10/2006 | Grundmann et al. | |
| 7,705,540 | B2 | 4/2010 | Bedynek et al. | |
| 2003/0102805 | A1 | 6/2003 | Hataoka et al. | |
| 2003/0178940 | A1 | 9/2003 | Yoshida et al. | |
| 2005/0093455 | A1 * | 5/2005 | Tamura et al. | 313/638 |
| 2006/0049764 | A1 | 3/2006 | Bedynek et al. | |
| 2007/0222387 | A1 | 9/2007 | Bittmann | |
| 2009/0129070 | A1 | 5/2009 | Wajata | |

FOREIGN PATENT DOCUMENTS

| | | | |
|---|---|---|---|
| CN | 1423302 | A | 6/2003 |
| CN | 1235260 | C | 12/2003 |
| CN | 1460279 | A | 12/2003 |

(Continued)

OTHER PUBLICATIONS

International Search Report of PCT/EP2008/054447 dated Aug. 1, 2008.

(Continued)

*Primary Examiner* — Anh Mai
*Assistant Examiner* — Elmito Breval

(57) ABSTRACT

A high-pressure discharge lamp may include a discharge vessel which is sealed in a gas-tight manner and in which electrodes and an ionizable fill for generating a gas discharge are enclosed, the ionizable fill being in the form of a mercury-free fill which includes xenon and halides of the metals sodium, scandium, zinc and indium, wherein the weight ratio of the halides of zinc and indium is in the range of from 20 to 100, and wherein the coldfilling pressure of xenon is in the range of from 1.3 megapascal to 1.8 megapascal.

5 Claims, 3 Drawing Sheets

FOREIGN PATENT DOCUMENTS

| | | | | |
|---|---|---|---|---|
| CN | 1747123 | A | | 3/2006 |
| EP | 0700579 | B1 | | 7/1997 |
| EP | 1465237 | A2 | | 10/2004 |
| EP | 1632985 | A1 | | 3/2006 |
| JP | 7042621 | A | | 2/1995 |
| JP | 8332484 | A | | 12/1996 |
| JP | 2006019054 | A | | 1/2006 |
| JP | 2007042621 | A | * | 2/2007 |
| JP | 2007059086 | A | | 3/2007 |
| JP | 2007172959 | A | | 7/2007 |
| WO | 2005112074 | A2 | | 11/2005 |
| WO | WO 2006046175 | A2 | * | 5/2006 |

OTHER PUBLICATIONS

English language abstract of JP 7042621 A, Feb. 10, 1995.
English language abstract of CN 1747123 A, Sep. 7, 2005.
English abstract for JP 8332484 A, Dec. 17, 1996.
English abstract for JP 2007059086 A, Mar. 8, 2007.
English abstract for JP 2006019054 A, Jan. 19, 2006.
English abstract for JP 2007172959 A, Jul. 5, 2007.

* cited by examiner

HIGH-PRESSURE DISCHARGE LAMP AND VEHICLE HEADLIGHT WITH HIGH-PRESSURE DISCHARGE LAMP

RELATED APPLICATIONS

The present application is a national stage entry according to 35 U.S.C. §371 of PCT application No.: PCT/EP2008/054447 filed on Apr. 11, 2008, which claims priority from German application No.: 10 2007 018 614.4 filed on Apr. 19, 2007.

TECHNICAL FIELD

Various embodiments relate to a high-pressure discharge lamp and a vehicle headlight with such a high-pressure discharge lamp.

BACKGROUND

Such a high-pressure discharge lamp is described, for example, in the laid-open specification EP 1 465 237 A2. The mercury-free, ionizable fill of the high-pressure discharge lamp disclosed in EP 1 465 237 A2 contains zinc iodide and indium iodide, wherein the weight ratio of zinc iodide and indium iodide is 12.5. The coldfilling pressure of the xenon is 1.18 megapascal and the discharge vessel has a volume of 24 $mm^3$. The high-pressure discharge lamp is used as a light source in a vehicle headlight.

SUMMARY

Various embodiments provide a high-pressure discharge lamp of the generic type with an improved luminous flux maintenance and an extended life.

This object is achieved according to the invention by a high-pressure discharge lamp, comprising: a discharge vessel which is sealed in a gas-tight manner and in which electrodes and an ionizable fill for generating a gas discharge are enclosed, the ionizable fill being in the form of a mercury-free fill which comprises xenon and halides of the metals sodium, scandium zinc and indium, wherein the weight ratio of the halides of zinc and indium is in the range of from 20 to 100, and wherein the coldfilling pressure of xenon is in the range of from 13 megapascal to 1.8 megapascal. Particularly advantageous embodiments of the invention are described in the dependent patent claims.

The high-pressure discharge lamp according to the invention has a discharge vessel which is sealed in a gas-tight manner and in which electrodes and an ionizable fill for the purpose of generating a gas discharge are enclosed, the ionizable fill being in the form of a mercury-free fill, which includes xenon and halides of the metals sodium, scandium, zinc and indium, and the weight ratio of the halides of zinc and indium being in the range of from 20 to 100, preferably 50, and the coldfilling pressure of the xenon being in the range of from 1.3 megapascal to 1.8 megapascal. It has been shown that, as a result, the decrease in the luminous flux over the operating time of the high-pressure discharge lamp and the increase in the running voltage of the high-pressure discharge lamp over its operating time can be reduced. That is to say that the high-pressure discharge lamp according to the invention has improved luminous flux maintenance in comparison with the high-pressure discharge lamp in accordance with the prior art and, as a result of the reduced rise in the running voltage over the operating time, can expect a longer life. In addition, the high-pressure discharge lamps according to the invention only demonstrate a slight shift in the color locus of the light emitted by them over their operating time. In particular, the color locus only migrates within the limits allowed pursuant to ECE Rule 99, which are represented by the trapezoid in FIG. 4. FIGS. 2 and 3 illustrate a comparison of the high-pressure discharge lamps in accordance with the prior art with the high-pressure discharge lamps according to the invention for the decrease in the luminous flux and the rise in the running voltage. FIG. 4 illustrates the shift in the color locus of the high-pressure discharge lamps according to the invention over the first 3000 operating hours.

Both the comparatively high coldfilling pressure of the xenon and the comparatively high weight proportion of the halides of zinc make a substantial contribution to the setting of the running voltage of the high-pressure discharge lamp according to the invention, i.e. the voltage which is set after conclusion of the starting phase, in the quasi steady-state operating state over the discharge path of the high-pressure discharge lamp according to the invention. The halides of indium are represented in such a low weight proportion that, although they contribute to the setting of the color locus of the light emitted by the high-pressure discharge lamp according to the invention, they do not make any notable contribution to the setting of the running voltage of the high-pressure discharge lamp according to the invention. In the high-pressure discharge lamp according to the invention, the halides of indium, in the same way as the halides of sodium and scandium, are primarily used for light emission.

Advantageously, the weight proportion of the halides of zinc is in the range of from 0.88 microgram to 2.67 micrograms per 1 $mm^3$ of discharge vessel volume, and the weight proportion of the halide of indium is in the range of from 0.026 microgram to 0.089 microgram per 1 $mm^3$ of discharge vessel volume. Iodides, bromides or chlorides can be used as the halides.

Advantageously, the weight proportion of the halides of sodium is in the range of from 6.6 micrograms to 13.3 micrograms per 1 $mm^3$ of the discharge vessel volume, and the weight proportion of the halides of scandium is in the range of from 4.4 micrograms to 11.1 micrograms per 1 $mm^3$ of the discharge vessel volume in order to ensure that the high-pressure discharge lamp generates white light with a color temperature of approximately 4000 kelvin, and the color locus remains in the range of white light, preferably within the limits of the trapezoid illustrated in FIG. 4, during the life of the high-pressure discharge lamp. In the case of a relatively low weight proportion, the sodium losses (as a result of diffusion through the vessel wall of the discharge vessel) and scandium losses (as a result of chemical reaction with the quartz glass of the discharge vessel) can no longer be compensated for, and in the case of a relatively high weight proportion, the color locus and the color temperature are altered.

The volume of the discharge vessel is advantageously less than 23 $mm^3$ in order to come as close as possible to the ideal for a point light source. For the use as a light source in a vehicle headlight or another optical system, the light-emitting part of the discharge vessel, i.e. the discharge space with the electrode enclosed therein, should have dimensions which are as small as possible. Ideally, the light source should be in the form of a point in order to be able to arrange it in the focal point of an optical imaging system. The high-pressure discharge lamp according to the invention comes closer to this ideal than the high-pressure discharge lamp according to the prior art since it preferably has a discharge vessel with a relatively small volume. The volume of the discharge vessel of the high-pressure discharge lamp according to the invention is therefore advantageously in the range of greater than or equal to 20 $mm^3$ to less than 23 $mm^3$. In the case of volumes which are smaller than 20 $mm^3$, there is the risk of the quartz glass of the discharge vessel having a tendency towards devitrification as a result of the very high wall loading occurring during lamp operation.

The distance between the electrodes of the high-pressure discharge lamp according to the invention is preferably less than 5 millimeters in order to come as close as possible to the ideal of a point light source. For the use as a light source in a motor vehicle headlight, the electrode distance is preferably 4.1 millimeters. As a result, the high-pressure discharge lamp according to the invention is matched in optimum fashion to the imaging ratios in the vehicle headlight.

The thickness or the diameter of the electrodes of the high-pressure discharge lamp is advantageously in the range of from 0.27 millimeter to 0.36 millimeter. Electrodes with a thickness in this value range can still be embedded sufficiently securely in the quartz glass of the discharge vessel and at the same time have sufficient current-carrying capacity, which is significant in particular during the so-called runup phase of the high-pressure discharge lamp, during which phase the lamp is operated at from 3 to 5 times its rated power and rated current. In the case of thinner electrodes, a sufficient current-carrying capacity is no longer ensured in the case of the mercury-free high pressure discharge lamp, and in the case of thicker electrodes, there would be the risk of the formation of cracks in the discharge vessel as a result of the occurrence of mechanical stresses owing to the markedly different coefficients of thermal expansion of the discharge vessel material, which is quartz glass, and the electrode material, which is tungsten or tungsten doped with thorium or thorium oxide.

The electrodes are each connected to a molybdenum foil embedded in the material of the discharge vessel, which molybdenum foils make a gas-tight current leadthrough possible, and the smallest distance between the respective molybdenum foil and that end of the electrode connected thereto which protrudes into the interior of the discharge vessel is advantageously at least 5.5 mm, in order to ensure as large a distance as possible between the respective molybdenum foil and the gas discharge which has its root at the electrode tips protruding into the discharge vessel. The resultant, comparatively large minimum distance between the molybdenum foils and the gas discharge has the advantage that the molybdenum foils are subjected to less thermal loading and less risk of corrosion owing to the halogens in the halogen compounds of the ionizable fill.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DETAILED DESCRIPTION

Figure 1:
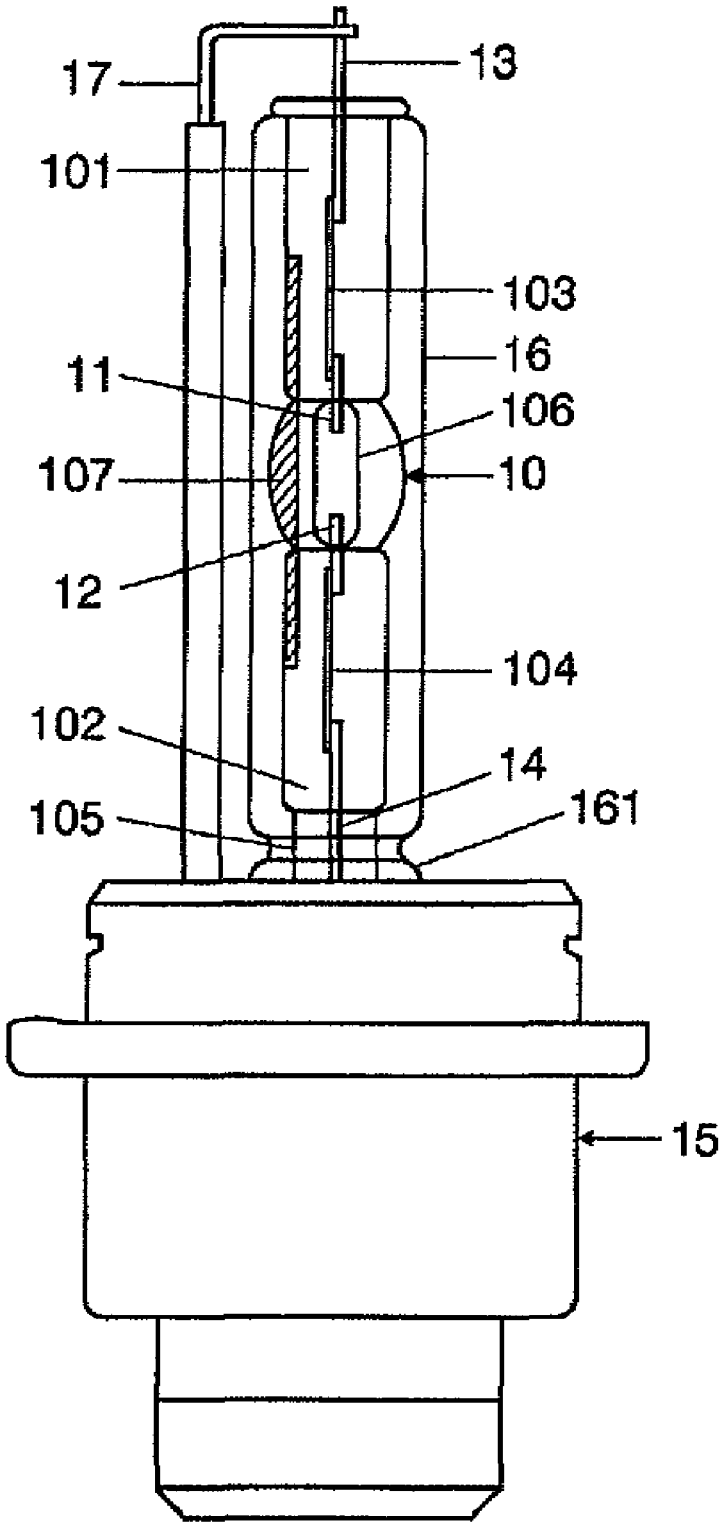
FIG. 1 shows a side view of a high-pressure discharge lamp in accordance with the preferred exemplary embodiment of the invention, in a schematic illustration.

The following detailed description refers to the accompanying drawings that show, by way of illustration, specific details and embodiments in which the invention may be practiced.

The preferred exemplary embodiment of the invention is a mercury-free metal-halide high-pressure discharge lamp with an electrical power consumption of 35 watts. This lamp is intended for use in a vehicle headlight. It has a discharge vessel 10 which is made from quartz glass, is sealed off at two ends and has a volume of 22.5 $mm^3$, in which an ionizable fill is enclosed in a gas-tight manner. In the region of the discharge space 106, the inner contour of the discharge vessel 10 is designed to be circular-cylindrical, and its outer contour is designed to be ellipsoidal. The inner diameter of the discharge space 106 is 2.6 mm and its outer diameter is 6.5 mm. The two ends 101, 102 of the discharge vessel 10 are each sealed off by means of a molybdenum foil fuse seal 103, 104. The molybdenum foils 103, 104 each have a length of 6.5 mm, a width of 2 mm and a thickness of 25 μm. Two electrodes 11, 12 are located in the interior of the discharge vessel 10, with the discharge arc responsible for the light emission being formed between said electrodes during lamp operation. The electrodes 11, 12 consist of tungsten.

Their thickness or their diameter is 0.30 mm. The length of the electrodes 11, 12 is in each case 7.5 mm. The distance between electrodes 11, 12 is 4.1 mm. The electrodes 11, 12 are each electrically conductively connected to an electrical terminal of the lamp base 15, which substantially consists of plastic, via one of the molybdenum foil fuse seals 103, 104 and via that power supply line 13 which is remote from the base and the power return line 17 or via the base-side power supply line 14. The overlap between the electrode 11 and the molybdenum foil 103 connected thereto is 1.3 mm±0.15 mm. The smallest distance between the molybdenum foil 103 and that end of the electrode 11 which protrudes into the interior of the discharge vessel 10 is 6.2 mm±0.15 mm. That is to say that the distance between the molybdenum foil 103 and the discharge arc forming in the discharge vessel 10 during lamp operation is 6.2 mm±0.15 mm. A similar statement also applies to the molybdenum foil 104 and the electrode 12. Details in this regard are disclosed in WO 2005/112074. The discharge vessel 10 is enveloped by a vitreous outer bulb 16. The outer bulb 16 has a protrusion 161, which is anchored in the base 15. The discharge vessel 10 has, on the base side, a tubular extension 105 made from quartz glass, in which the base-side power supply line 14 runs.

That surface region of the discharge vessel 10 which faces the power return line 17 is provided with a transparent, electrically conductive coating 107. This conductive coating 107 extends in the longitudinal direction of the lamp over the entire length of the discharge space 106 and over part, approximately 50 percent, of the length of the sealed-off ends 101, 102 of the discharge vessel 10. The coating 107 is applied on the outer side of the discharge vessel 10 and extends over approximately 5% to 10% of the circumference of the discharge vessel 10. However, the coating 107 can also extend over 50 percent of the circumference of the discharge vessel 10 or even over more than 50 percent of the circumference of the discharge vessel 10. An embodiment in which the coating 107 has such a width has the advantage that it increases the efficiency of the high-pressure discharge lamp since it reflects part of the infrared radiation produced by the discharge back into the discharge vessel and, as a result, ensures selective heating of the colder regions of the discharge vessel 10 which are beneath the electrodes during lamp operation and in which the metal halides of the ionizable fill accumulate. The coating 107 consists of doped tin oxide, for example of tin oxide doped with fluorine or antimony or for example of tin oxide doped with boron and/or lithium. This high-pressure discharge lamp is operated in a horizontal position, i.e. with electrodes 11, 12 arranged in a horizontal plane, wherein the lamp is aligned in such a way that the power return line 17 runs beneath the discharge vessel 30 and the outer bulb 16. Details of this coating 107 which acts as a starting aid are described in EP 1 632 985 A1. The outer bulb 16 consists of quartz glass which has been doped with substances absorbing ultraviolet rays, such as cerium oxide and titanium oxide, for example. Suitable glass compositions for the outer bulb glass are disclosed in EP 0 700 579 B1.

sodium iodide: 10.2 μg/mm$^3$
scandium iodide: 7.3 μg/mm$^3$
zinc iodide: 2.2 μg/mm$^3$
indium iodide: 0.044 μg/mm$^3$ The ionizable fill enclosed in the discharge vessel consists of xenon with a coldfilling pressure, i.e. a filling pressure measured at a room temperature of 22° C., of 1.6 megapascal, of 0.23 mg of sodium iodide, 0.165 mg of scandium iodide, 0.05 mg of zinc iodide and 0.001 mg of indium iodide. The running voltage of the lamp is approximately 43 volts. Its color temperature is slightly above 4000 kelvin. If the iodide components of the fill are converted for 1 mm$^3$ of the discharge vessel volume, the following values in micrograms (μg) per cubic millimeter (mm$^3$) result:

| | |
|---|---|
| sodium iodide: | 10.2 μg/mm$^3$ |
| scandium iodide: | 7.3 μg/mm$^3$ |
| zinc iodide: | 2.2 μg/mm$^3$ |
| indium iodide: | 0.044 μg/mm$^3$ |

The weight ratio of zinc iodide to indium iodide in the ionizable fill is therefore 50. The color rendering index of the metal-halide high-pressure discharge lamp is 65 and its luminous efficiency is 90 μm/W. The wall loading is approximately 80 W/cm$^2$.

The metal-halide high-pressure discharge lamp according to the invention, is operated, directly after starting of the gas discharge in the discharge vessel, at from three to five times its rated power or rated current in order to ensure rapid evaporation of the metal halides in the ionizable fill. Directly after starting of the gas discharge, said gas discharge will be performed almost exclusively by the xenon since only the xenon is present in gaseous form in the discharge vessel at this time. At this time and during the so-called runup phase, during which the metal halides of the ionizable fill transfer to the vapor phase, the high-pressure discharge lamp therefore functions as a xenon ultra-high-pressure discharge lamp, in the case of which both the light emission and the electrical properties of the discharge, in particular the voltage drop across the discharge path, are determined purely by the xenon. Only when the abovementioned iodides of the ionizable fill have evaporated and said iodides contribute to the discharge is a quasi steady-state operating state of the lamp reached, in which the lamp is operated at its rated power of 35 watts and a running voltage of 43 volts. The term running voltage therefore refers to the operating voltage of the high-pressure discharge lamp during quasi steady-state operation.

Figure 2:
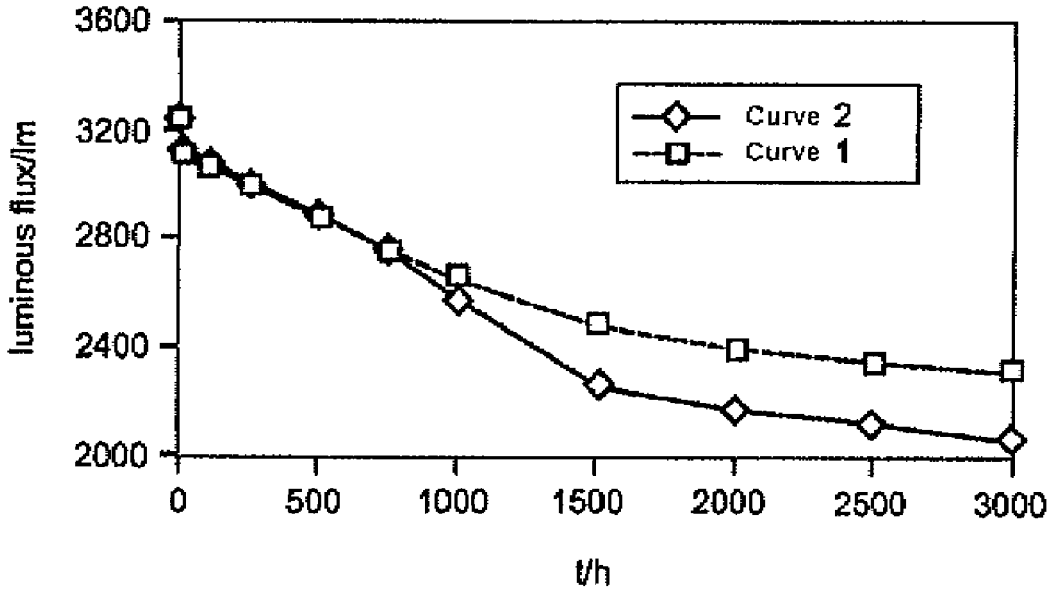
FIG. 2 shows a comparison of the decrease in the luminous flux as the operating time increases between the high-pressure discharge lamp according to the invention and the high-pressure discharge lamp in accordance with the prior art.
Figure 3:
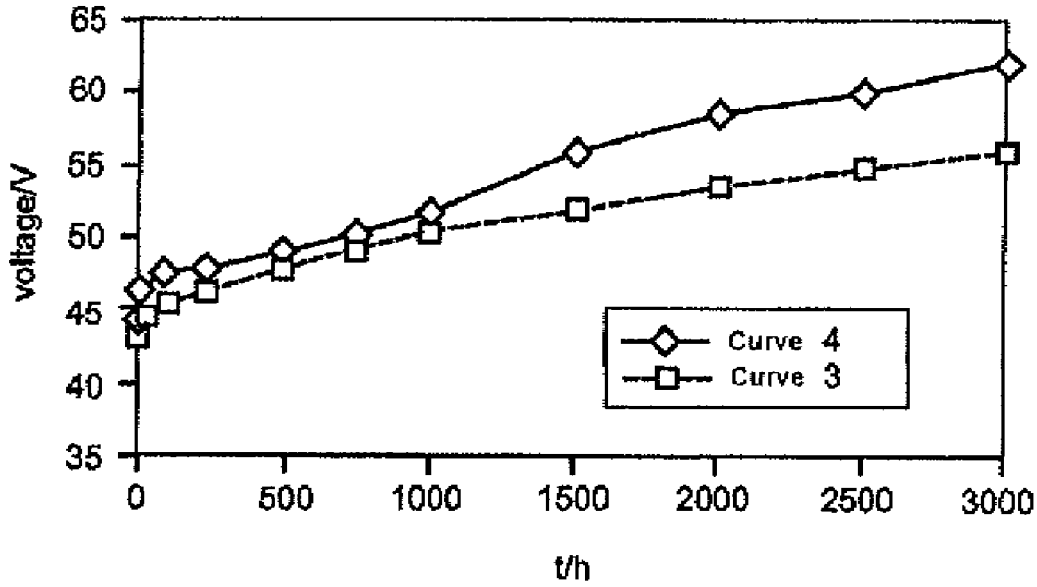
FIG. 3 shows a comparison of the increase in the running voltage as the operating time increases between the high-pressure discharge lamp according to the invention and the high-pressure discharge lamp in accordance with the prior art.
Figure 4:
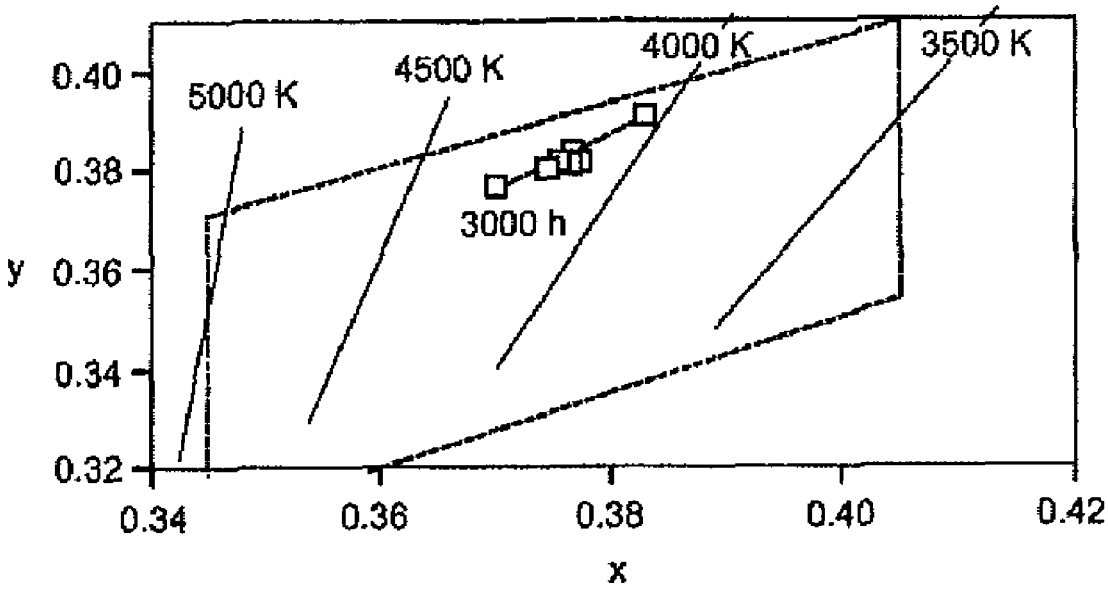
FIG. 4 shows an illustration of the shift in the color locus of the light emitted by the high-pressure discharge lamps according to the invention as the operating time of the lamps increases.

The measurements illustrated in FIGS. 2 to 4 were all performed during quasi steady-state lamp operation.

FIG. 2 illustrates the dependence of the luminous flux on the operating time of the high-pressure discharge lamp for metal-halide high-pressure discharge lamps according to the invention in comparison with the metal-halide high-pressure discharge lamps in accordance with the prior art. Curve 1 shows the profile for the lamps according to the invention and curve 2 shows the profile for lamps in accordance with the prior art. In both cases, the initial luminous flux is approximately 3200 lumens. After 1500 operating hours, the luminous flux in the case of the high-pressure discharge lamps in accordance with the prior art has already dropped to a value of below 2400 lumens, while in the case of the high-pressure discharge lamps according to the invention it still has a value of above 2400 lumens. The difference is even more noticeable after 3000 operating hours. The high-pressure discharge lamps according to the invention still have a luminous flux of approximately 2300 lumens after 3000 operating hours, while this luminous flux has fallen to a value of approximately 2100 lumens in the case of the high-pressure discharge lamps in accordance with the prior art.

FIG. 3 illustrates the dependence of the running voltage on the operating time of the high-pressure discharge lamp for high-pressure discharge lamps according to the invention in comparison with high-pressure discharge lamps in accordance with the prior art. Curve 3 shows the profile for the high-pressure discharge lamps according to the invention and curve 4 shows the profile for the high-pressure discharge lamps in accordance with the prior art. The initial running voltage in the case of the high-pressure discharge lamps according to the invention is approximately 43 volts and has increased to a value of approximately 56 volts after 3000 operating hours. The percentage increase in the running voltage in the case of the high-pressure discharge lamps according to the invention is therefore approximately 30 percent. In the case of the high-pressure discharge lamps in accordance with the prior art, the initial running voltage is approximately 47 volts and has increased to a value of approximately 63 volts after 3000 operating hours. That is to say that the percentage increase in the running voltage in the case of the high-pressure discharge lamps in accordance with the prior art is approximately 40 percent. The increase in the running voltage can be attributed to a loss of sodium and scandium ions and the correspondingly superfluous iodine in the ionizable fill.

FIG. 4 illustrates the shift in the color locus of the light emitted by the high-pressure discharge lamps as a function of the operating time of the high-pressure discharge lamps for the metal-halide high-pressure discharge lamp according to the invention. At the beginning, the color locus of the high-pressure discharge lamps according to the invention is at the color locus coordinates x=0.383 and y=0.39 and at a color temperature of approximately 4000 kelvin. As the operating time increases, the color locus of the emitted light is shifted to smaller x and y values and a higher color temperature. After 3000 operating hours the color locus of the light emitted by the high-pressure discharge lamps according to the invention is at x=0.37 and y=0.369 and a color temperature of approximately 4300 kelvin. This color locus and color temperature shift can be attributed to the change in the composition of the ionizable fill which has already been mentioned above and which is brought about by the loss of sodium and scandium. As is apparent from FIG. 4, the color locus of the light emitted by the high-pressure discharge lamp according to the invention remains within the trapezoid illustrated by dashed lines, which delimits the color loci of the white light, throughout the measured operating time. That is to say that the high-pressure discharge lamps according to the invention emit white light throughout their operating time.

The invention is not restricted to the exemplary embodiment of the invention explained in more detail above. For example, the weight proportions of the components of the ionizable fill can be varied within the abovementioned limits. In addition, the geometry or dimensions of the electrodes and molybdenum foils can be varied, for example. In particular, the thickness of the electrodes 11, 12 can be increased, for example to a value of 0.33 millimeter, in order to make them suitable for a higher current intensity. In addition, the overlap between the electrode 11 or 12 and the molybdenum foil 103 or 104 connected thereto can also have a value different from the abovementioned value. Preferred values for the overlap are in the range of from 1 mm to 1.6 mm. Furthermore, the volume of the discharge vessel 10 can also have a value different from the value in the preferred exemplary embodiment. The volume of the discharge vessel can only be determined with an accuracy of approximately 10 percent.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A high-pressure discharge lamp, comprising:

a discharge vessel made from quartz glass which is sealed in a gas-tight manner and in which electrodes and an ionizable fill for generating a gas discharge are enclosed, the ionizable fill being in the form of a mercury-free fill which comprises xenon and halides of the metals sodium, scandium, zinc and indium, wherein the weight ratio of the halides of zinc and indium is in the range of from 20 to 100, wherein the weight proportion of the halides of zinc is in the range of from 0.88 microgram to 2.67 micrograms per 1 $mm^3$ of discharge vessel volume, and the weight proportion of the halide of indium is in the range of from 0.026 microgram to 0.089 microgram per 1 $mm^3$ of discharge vessel volume, wherein the weight proportion of the halides of sodium is in the range of from 6.6 micrograms to 13.3 micrograms per 1 $mm^3$ of the discharge vessel volume, and the weight proportion of the halides of scandium is in the range of from 4.4 micrograms to 11.1 micrograms per 1 $mm^3$ of the discharge vessel volume, wherein the coldfilling pressure of xenon is in the range of from 1.3 megapascal to 1.8 megapascal, and wherein the volume of the discharge vessel is greater than or equal to 20 $mm^3$ and less than 23 $mm^3$.

2. The high-pressure discharge lamp as claimed in claim 1, wherein the electrodes are arranged at a distance of less than 5 millimeters from one another.

3. The high-pressure discharge lamp as claimed in claim 1, wherein the thickness or the diameter of the electrodes is in the range of from 0.27 millimeter to 0.36 millimeter.

4. The high-pressure discharge lamp as claimed in claim 1, wherein the electrodes are each connected to a molybdenum foil embedded in the material of the discharge vessel, and the smallest distance between the respective molybdenum foil and that end of the electrode connected thereto which protrudes into the interior of the discharge vessel is at least 5.5 millimeters.

5. A vehicle headlight, comprising: a high-pressure discharge lamp, the high-pressure discharge lamp comprising: a discharge vessel made from quartz glass which is sealed in a gas-tight manner and in which electrodes and an ionizable fill for generating a gas discharge are enclosed, the ionizable fill being in the form of a mercury-free fill which comprises xenon and halides of the metals sodium, scandium, zinc and indium, wherein the weight ratio of the halides of zinc and indium is in the range of from 20 to 100, wherein the weight proportion of the halides of zinc is in the range of from 0.88 microgram to 2.67 micrograms per 1 $mm^3$ of discharge vessel volume, and the weight proportion of the halide of indium is in the range of from 0.026 microgram to 0.089 microgram per 1 $mm^3$ of discharge vessel volume, wherein the weight proportion of the halides of sodium is in the range of from 6.6 micrograms to 13.3 micrograms per 1 $mm^3$ of the discharge vessel volume, and the weight proportion of the halides of scandium is in the range of from 4.4 micrograms to 11.1 micrograms per 1 $mm^3$ of the discharge vessel volume, wherein the coldfilling pressure of xenon is in the range of from 1.3 megapascal to 1.8 megapascal, and wherein the volume of the discharge vessel is greater than or equal to 20 $mm^3$ and less than 23 $mm^3$.

* * * * *